US005893671A

United States Patent [19]

Bellue

[11] Patent Number: 5,893,671

[45] Date of Patent: Apr. 13, 1999

[54] ERGONOMIC WRITING INSTRUMENT

[76] Inventor: John W. Bellue, 422 Ninth St., Huntington, W. Va. 25701

[21] Appl. No.: 08/805,400

[22] Filed: Feb. 24, 1997

[51] Int. Cl.[6] ..... B43K 19/00; B43K 19/14; B43K 19/16; B43K 23/004

[52] U.S. Cl. ..... 401/6; 401/88; 401/96; D19/50

[58] Field of Search ..... 401/88, 6, 96, 401/97; D19/47, 48, 49, 50

[56] References Cited

U.S. PATENT DOCUMENTS

| | | | |
|---|---|---|---|
| D. 18,032 | 1/1888 | Zeckendorf . | |
| D. 22,511 | 6/1893 | Goldsmith | D19/49 |
| D. 22,524 | 6/1893 | Eckert et al. . | |
| D. 31,072 | 6/1899 | Lake . | |
| D. 79,456 | 9/1929 | Coby | D19/49 |
| D. 81,435 | 6/1930 | Coby | D19/49 |
| D. 136,595 | 11/1943 | Pleasants . | |
| D. 191,341 | 10/1961 | Schwarzenbach . | |
| D. 202,395 | 9/1965 | Lamb . | |
| D. 237,705 | 11/1975 | Anderson . | |
| D. 323,350 | 1/1992 | Johansson . | |
| 1,920,361 | 8/1933 | Daneke | 401/96 |
| 2,180,132 | 11/1939 | Zoll | D19/49 X |
| 2,790,202 | 4/1957 | Lorenian | 401/96 X |
| 4,149,811 | 4/1979 | Coffman | 401/6 |
| 5,090,831 | 2/1992 | Kageyama et al. . | |
| 5,207,522 | 5/1993 | Kageyama et al. . | |
| 5,228,794 | 7/1993 | Hochstetler . | |

FOREIGN PATENT DOCUMENTS

| | | | |
|---|---|---|---|
| 3137456 | 6/1983 | Germany | 401/6 |
| 78288 | 11/1917 | Switzerland | 401/96 |
| 2143780 | 2/1985 | United Kingdom | 401/6 |

*Primary Examiner*—Steven A. Bratlie
*Attorney, Agent, or Firm*—Robert N. Blackmon

[57] ABSTRACT

A writing instrument having a ergonomic configuration and methods for making the instrument are provided. The instrument is elongated having an equilateral triangular cross-section and having a uniform partial twist along the length thereof. The partial twist permits flat surface engagement for the index finger, middle finger and for the hand between the base of thumb and the base of the index finger of the user. The uniform twist in combination with the equilateral cross-sectional shape also permits tight packing in bulk, and the partial twist permits flat sided engagement with the resting surface (desk top). A method for making the instrument in the form of a rigid pencil is also provided.

9 Claims, 3 Drawing Sheets

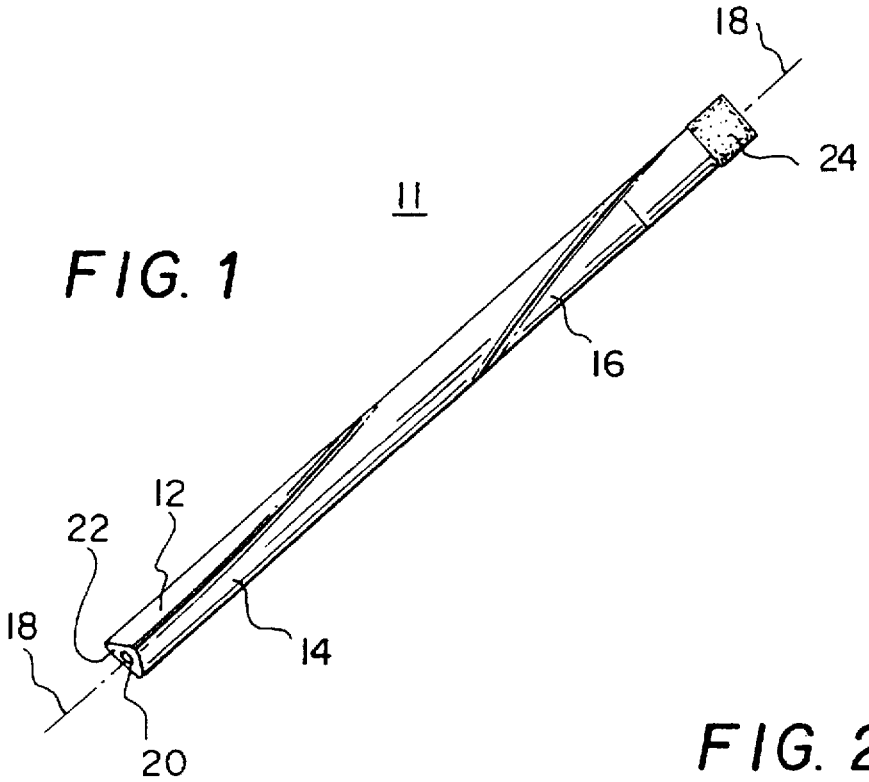
FIG. 1
FIG. 2
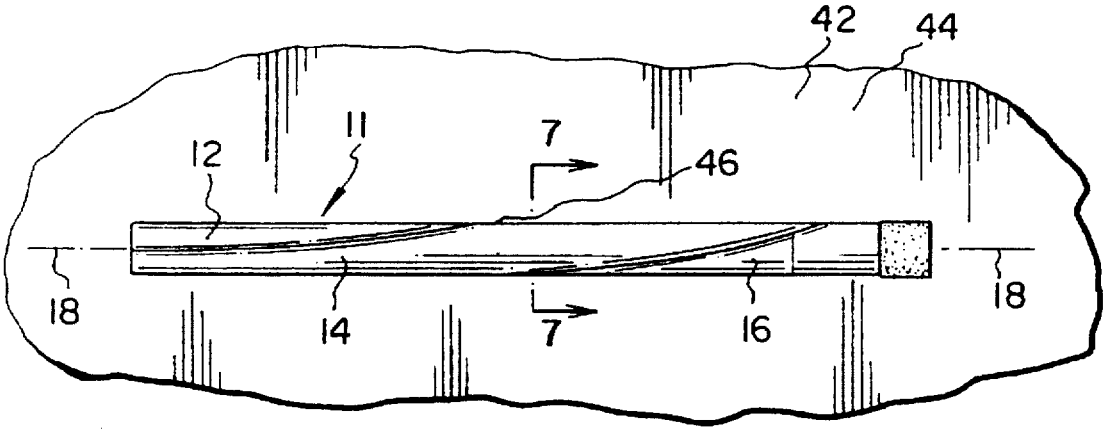
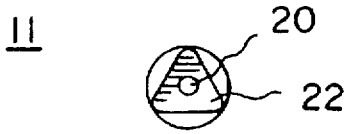
FIG. 3

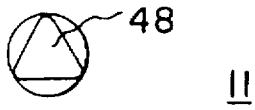
FIG. 4
FIG. 5
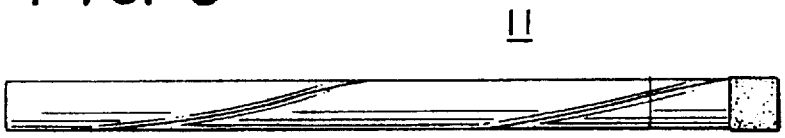
FIG. 6
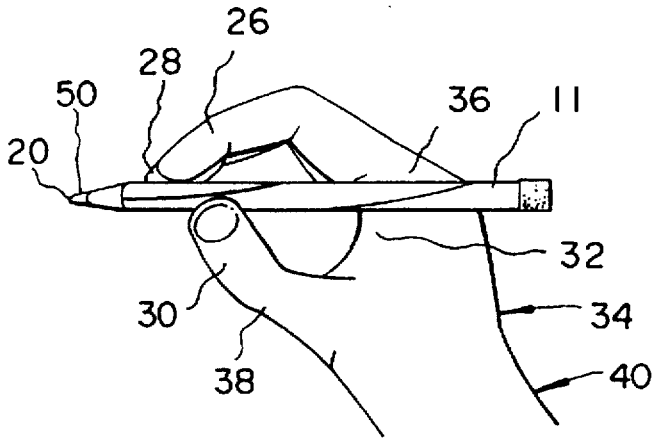
FIG. 7
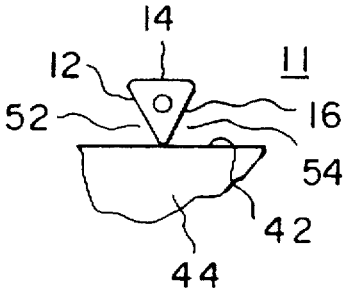
FIG. 8
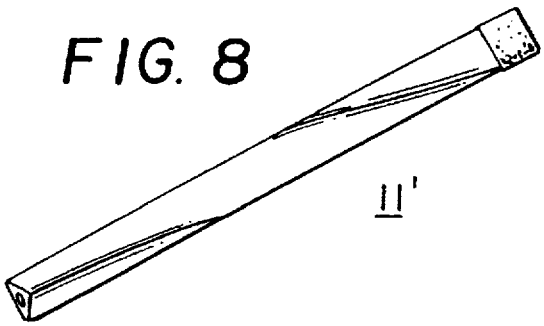

ERGONOMIC WRITING INSTRUMENT

BACKGROUND OF THE INVENTION

1. Field of the Invention

The present invention relates to writing instruments and methods for making thereof, and more particularly relates to shaped writing instruments and methods for making thereof.

2. Description of the Related Art

Various well known writing instruments have found common use and appeal. Examples include conventional hexagon cross-sectional pencils shaped to reduce unintended rolling and slippage, and round cross-sectional pens having polymeric slip reducing materials for the shells thereof and having cap clips for reducing rolling and for attaching to pockets. Generally, these designs have not been as ergonomically well designed for prolonged periods of use based on the way that such pencils and pens are conventionally held during extended writing periods. Additionally, many of these prior pens have a tendency to roll on desk tops.

Prior attempts to improve the ergonomic designs of such pens and pencils have for example lead to the use of various scooped portions for receiving the index finger or have lead to non-uniform curvatures. For pencils, the bodies of which are consumed during use, the use of a non-uniform shape would undesirably result in frequently changing grip configurations following sharpening. Also, various ergonomic pencil configurations would not be suitable for being sharpened in conventional pencil sharpeners. Prior writing instruments have been disclosed in Hochstetler U.S. Pat. No. 5,228,794 issued Jul. 20, 1993 which discloses a writing instrument having groove spirals around a shell; Pleasants U.S. Design Pat. No. 136,595 issued Nov. 2, 1943 which discloses a pen holder; Lamb U.S. Design Pat. No. 202,395 issued Sep. 21, 1965 which discloses a holder for a writing instrument having a non-uniform cross-section; Zeckendorf U.S. Design Pat. No. 18,032 issued Jan. 24, 1888 which discloses a lead pencil having a pair of flat sides and a curved side; Eckert et al U.S. Design Pat. No. 22,524 issued Jun. 13, 1893 which discloses a pen holder having spirals; Fuchs U.S. Design Pat. No. 191,341 issued Sep. 12, 1961 which discloses a mechanical pencil; Anderson U.S. Design Pat. No. 237,705 issued Nov. 18, 1975 which discloses a pen; Johansson U.S. Design Pat. No. 323,350 issued Jan. 21, 1992 which discloses a pen; Tucker U.S. Design Pat. No. 31,072 issued Jun. 27, 1899 which discloses a pencil having spirally formed ribs; Kageyama et al. U.S. Pat. No. 5,090,831 issued Feb. 25, 1992 which discloses a writing instrument; Kageyama U.S. Pat. No. 5,207,522 issued May 4, 1993 which discloses a mechanical pencil; and Kageyama et al. U.S. Pat. No. 5,236,270 issued Aug. 17, 1993 which discloses a writing tool; all of which are incorporated herein by reference in their entireties.

The non-uniform design of some of these designs could result in inefficient packaging; some of the uniform designs do not provide for ease in picking up the writing utensil from a resting position; and some of the spiral designs are too tightly wound to provide for comfortable long term writing.

BRIEF DESCRIPTION OF THE DRAWINGS

FIG. 1 is a perspective view of a writing instrument for a right hand configuration according to the present invention;

FIG. 2 is a top cutaway view of a desk having thereon the writing instrument of FIG. 1;

FIG. 3 is a front end elevational view of the writing instrument of FIG. 1;

FIG. 4 is a rear end elevational view of the writing instrument of FIG. 1;

FIG. 5 is a side elevational view of the writing instrument of FIG. 1;

FIG. 6 is a cutaway view of a right hand holding the instrument of the present invention;

FIG. 7 is a cross-sectional cutaway view of the writing instrument on a desk taken along line 7—7 of FIG. 2;

FIG. 8 is a perspective view of an alternative embodiment of the writing instrument for a left hand configuration;

SUMMARY OF THE INVENTION

Figure 9:
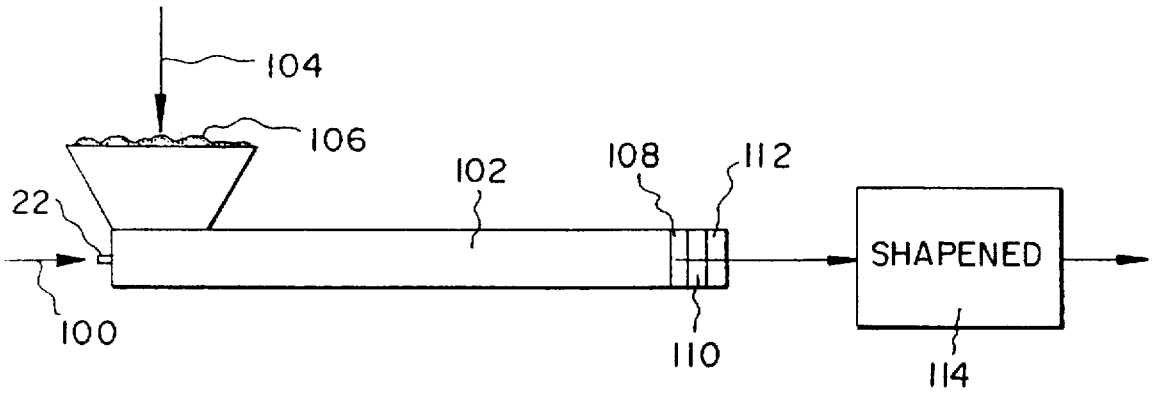
FIG. 9 is a schematic of an extrusion process for making the writing instruments of the present invention.

The present invention involves a writing instrument having a ergonomic configuration, and methods for making the instrument. The instrument is elongated having an equilateral triangular cross-section and having a uniform partial twist along the length thereof. The partial twist permits flat surface engagement for the index finger, middle finger and for the hand between the base of thumb and the base of the index finger of the user. The uniform twist in combination with the equilateral cross-sectional shape also permits tight packing in bulk, and the partial twist permits flat sided engagement with the resting surface (desk top).

DETAILED DESCRIPTION OF THE INVENTION

As best shown in FIG. 1, a writing instrument (11) such as a lead pencil, has a equilateral triangular vertical cross-section, preferably with slightly arcuate (rounded) terminal ends (edges)where the sides thereof (12, 14, 16) come together, as best shown in FIG. 7 which provides the instrument (11) with the three sides (12, 14, 16). The sides (12, 14, 16) gently spiral about a central axis (18) along which a pencil lead (20) is positioned. The spiral (twist) is preferably a one-half twist from the writing end (22) of the instrument (11) to the eraser end (24) of the instrument (11). The gentle twist of the instrument (11) permits the instrument (11) to have relative large flat sides (12, 14, 16) for contact with the index finger (26), middle finger (28), thumb (30) and the portion (32) of the hand (34) between the base (36) of the index finger (26) and the base (38) of the thumb (30). For example, a first side (12) could be in flat direct contact with the distal end of the index finger (26), the second side (14) could be in flat direct contact with the distal end of the thumb (30), the third side (16) could be in direct flat contact with the distal end of the middle finger (28), and the first side (12) could be in direct flat contact with the hand (34) between the base (36) of the index finger (26) and the base (38) of the thumb (30). The half twist (preferably 150 to 210 degrees, more preferably 170 to 190 degrees, and most preferably 180 degrees) provides the instrument (11) with a flat surface (formed by one of the sides (12, 14, 16) for direct contact with a top (42) of a desk (44) regardless of the rotational orientation of the instrument (11). Also, the rotational nature of the instrument (11) with the large flat surfaces facilitates the picking up of the instrument (11) by the hand (34) of a user (40) of the instrument (11), specifically as shown in FIG. 2 the instrument (11) will have a middle segment (46) having flat side (14) in an uppermost position with two sides (12, 14) tapering downward therefrom toward the desk top (42).

The middle segment (46), due to the tapering sides (12, 14), provides deep recesses (52, 54) for picking up the instrument (11). The instrument (11) of the present invention is especially useful for people (40), such as some of the elderly population and some people having disabilities, who have difficulty picking up objects such as conventional hexagonal cross-sectional pencils and round pens.

As shown in FIG. 3, the front end (22) of the instrument (pencil) (11) has a flat equilateral triangular configuration prior to sharpening. As shown in FIG. 4, the rear end (24) of the instrument preferably has an eraser (48) which preferably also has an equilateral cross-sectional configuration, and due to its short length may either have a conforming twist or may be twist-free without adversely affecting the desired properties of the instrument (11). The uniform nature of the twist of the instrument (11) is also illustrated by FIG. 5.

In use, the instrument (11) when in the form of a wood/lead pencil (11), has a sharpened writing point (50) which is the result of sharpening front end (22) to a point (50) so that the lead (20) is suitable for writing. As shown in FIG. 7, the middle segment (46) has sides (12, 16) tapering downwardly and inwardly from a side (16) for providing the desired recesses (52, 54) between the sides (12, 16 respectively) and the desk top (42) for permitting a large space for grasping fingers, for example index finger (26) and thumb (30), to be inserted between the sides (12, 16) and the desk top (42). A suitable pencil (11) would have a length from front end (22) to rear end (24) of 7 to 8 inches, and preferably each side (12, 14, 16) has a width of approximately a quarter inch for example three eighths of an inch. The lead (22) is a writing element (22) and in the situation where the instrument is a pen, the writing element (22) may be in the form of a ball-point ink cartridge.

As shown in FIG. 9, the writing instrument may be made by extruding a body compound about a writing lead, for example a suitable body compound may be a thermoplastic or thermoset composition, and a suitable compound may be a wood powder/glue mixture having suitable levels of wood powder to have desired properties for sharpening of the instrument (11) and having sufficient levels of glue for the flowability of the wood powder. Conventional wood powders and conventional fast hardening wood glues may be used in the (coextrusion, extrusion) process. The process involves feeding (100) a lead (22) to a extruder (102), feeding (104) a body compound (106) to the extruder (102), extruding (coextruding) the body compound in fluid form and the lead (22) to surround the lead with body compound, shaping (108) the body compound about the lead by forcing the fluid body compound and the lead through a slowly rotating triangular die to produce a spiral triangular cross-sectional body about the lead, hardening (110) the body compound about the lead by cooling or by reaction (crosslinking); and (112) cutting the body/lead to produce an unsharpened writing instrument. The instrument may then be sharpened (114) by a conventional sharpener. Suitable wood powder may be a pine wood powder.

Figure 10:
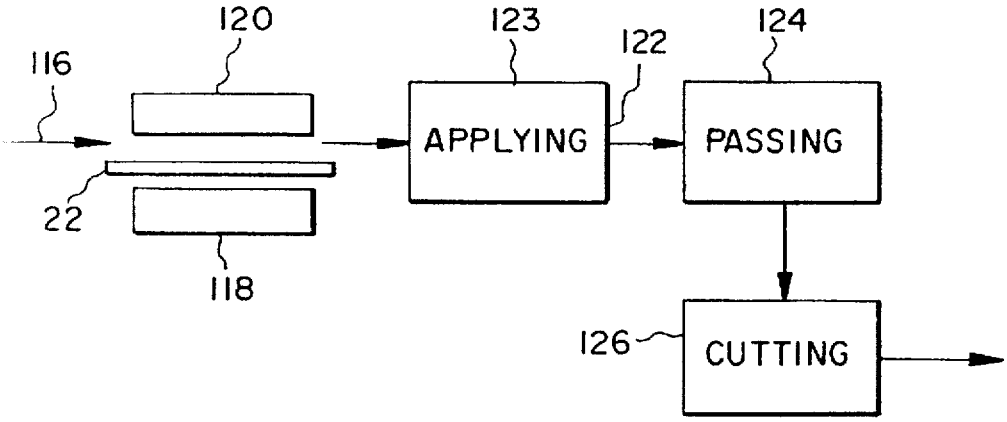
FIG. 10 is a schematic of a shaving process for making the writing instruments of the present invention.

As shown in FIG. 10, the writing instrument may also be produced by feeding (116) a lead (22) between two rectangular body halves (118, 120), applying glue (123) to at least one grooved surface of one of said halves, pressing said halves (118, 120) to form a square block (122), allowing said glue to fixedly attach said halves together, passing (124) said block (122) through a triangular shaver in a relative rotational arrangement to produce a spiraled body contain the lead, and cutting (126) the block (122) to produce the unsharpened writing instrument. The writing instrument may then be sharpened with a conventional sharpener. As shown in FIG. 8, an opposite spiral writing instrument (11') is suitable for left handed persons.

What is claimed is:

1. A writing instrument comprising:

(a) an elongated body having a uniform equilateral triangular cross-section along the length thereof said body having a uniform twist of between 150 degrees and 210 degrees along the length thereof, and (b) a writing element within said body.

2. The writing instrument of claim 1 wherein said twist is between 170 and 190 degrees.

3. The writing instrument of claim 1 wherein said twist is 180 degrees.

4. The writing instrument of claim 1 wherein said body is wood and said element is graphite lead.

5. The writing instrument of claim 1 wherein said instrument has an eraser having an equilateral triangular cross-section.

6. The writing instrument of claim 1 wherein said instrument has three twisting equal width sides each having widths of between 0.25 and 0.375 inches.

7. A method for providing an ergonomic writing instrument having an elongated body having a uniform equilateral triangular cross-section along the length thereof, said body having a uniform twist of between 150 degrees and 210 degrees along the length thereof, said method comprising:

(a) coextruding a lead and body compound to surround the lead with a fluid compound;

(b) passing the lead and surrounding fluid compound through a rotating die having a triangular opening;

(c) hardening the compound to provide a blank having a spiral triangular cross-sectional rigid body and a central graphite writing element;

(d) cutting the blank to produce an unsharpened writing instrument.

8. The method of claim 7 wherein said method futher involves sharpening the instrument.

9. The method of claim 8 wherein said body compound comprises wood particulates.

* * * * *